US012478093B2

(12) United States Patent
Fiscella et al.

(10) Patent No.: US 12,478,093 B2
(45) Date of Patent: Nov. 25, 2025

(54) APPARATUS AND METHOD FOR FILLING SMOKING CONES

(71) Applicants: Anthony S. Fiscella, Gilbert, AZ (US); Joseph Fiscella, Anaheim, CA (US)

(72) Inventors: Anthony S. Fiscella, Gilbert, AZ (US); Joseph Fiscella, Anaheim, CA (US)

( * ) Notice: Subject to any disclaimer, the term of this patent is extended or adjusted under 35 U.S.C. 154(b) by 469 days.

(21) Appl. No.: 18/138,783

(22) Filed: Apr. 25, 2023

(65) Prior Publication Data

US 2024/0358064 A1 Oct. 31, 2024

(51) Int. Cl.
*A24C 5/42* (2006.01)

(52) U.S. Cl.
CPC ..... *A24C 5/42* (2013.01)

(58) Field of Classification Search
None
See application file for complete search history.

*Primary Examiner* — Phu H Nguyen
(74) *Attorney, Agent, or Firm* — Bruce A. Lev

(57) ABSTRACT

An apparatus and method for filling smoking cones includes a hollow cylindrical body having a cone connector nozzle on one end, a push-rod opening at an opposite end, and a filler port on one side thereof. A locking cap is also included and used to releasably retain a cone to the cone connector nozzle, and a push-rod is included and used to push smoking material placed within the hollow cylindrical body via the filler port into the smoking cone.

9 Claims, 6 Drawing Sheets

APPARATUS AND METHOD FOR FILLING SMOKING CONES

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to smoking cones, and more specifically to apparatuses and methods for filling smoking cones.

2. Description of the Related Art

Prior art apparatus and method for filling smoking cones use push-rods and funnel-like mechanisms to fill smoking cones. However, this becomes difficult and messy when transferring smoking material from a tray or vessel into the funnel and subsequently into the smoking cone. These inefficient apparatuses and methods results in significant losses of smoking material, and lots of extra effort cleaning up messes left behind. Accordingly, the present invention overcomes the disadvantages associated with the prior art, by providing an apparatus and method for filling smoking cones that includes a hollow cylindrical body having a filler port on one side thereof adapted to be placed upon a tray or the like full of smoking material, such that the smoking material can be easily and efficiently placed within the interior of the hollow cylindrical body via the filler port, and then pushed within a smoking cone.

BRIEF SUMMARY OF THE INVENTION

In view of the foregoing disadvantages inherent in the known types of apparatuses and methods for filling smoking cones, the instant invention sets forth an apparatus and method for filling smoking cones that includes a hollow cylindrical body having a cone connector nozzle on one end, a push-rod opening at an opposite end, and a filler port on one side thereof. A locking cap is also included and used to releasably retain a cone to the cone connector nozzle, and a push-rod is included and used to push smoking material placed within the hollow cylindrical body via the filler port into the smoking cone, with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
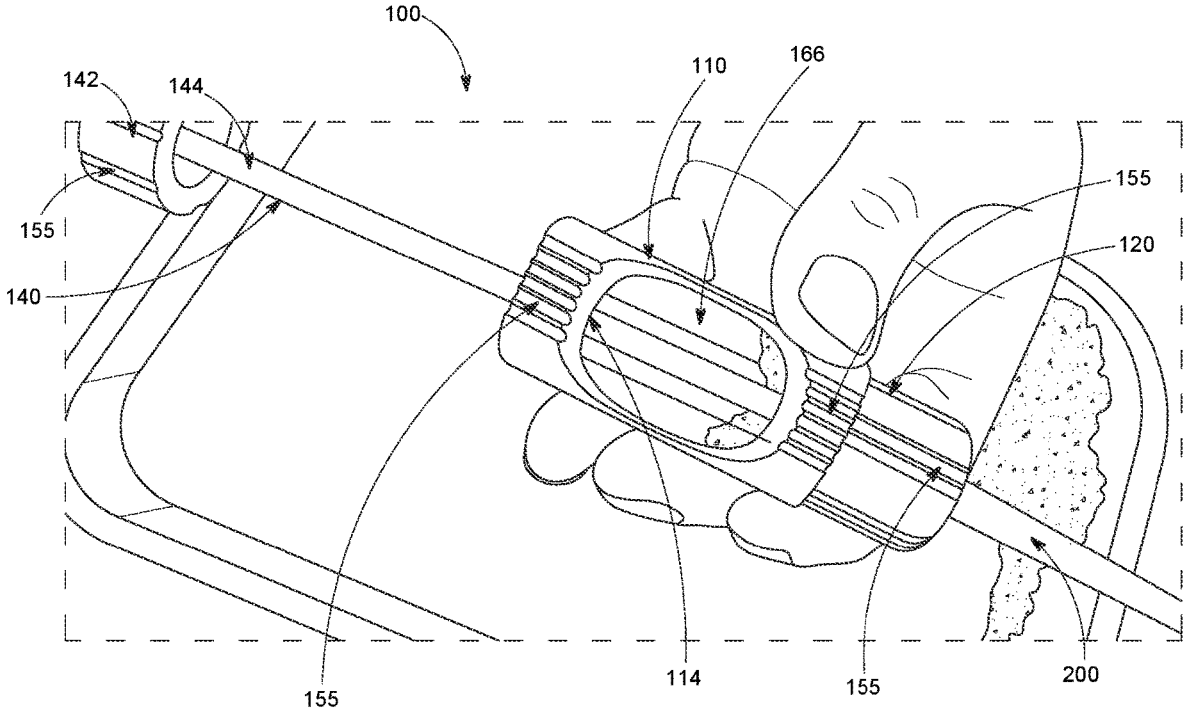
FIG. 1 shows a perspective view of the apparatus and method for filling smoking cones according to the preferred embodiment of the present invention.
Figure 2:
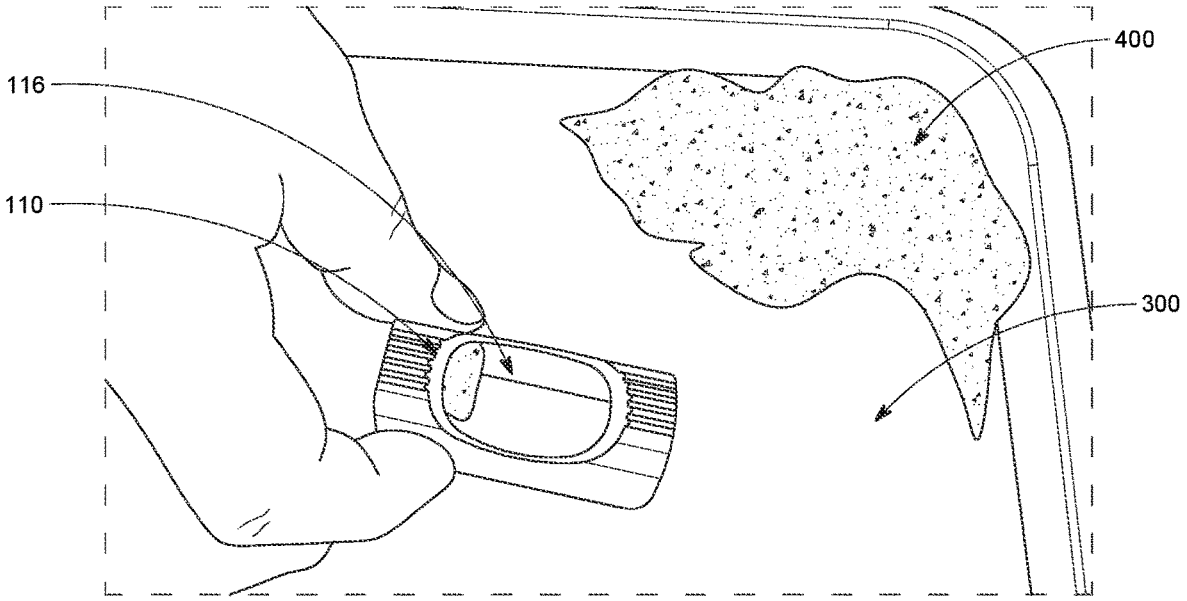
FIG. 2 shows a perspective view of hollow cylindrical body adjacent a tray including smoking material thereon according to the preferred embodiment of the present invention of FIG. 1.
Figure 3:
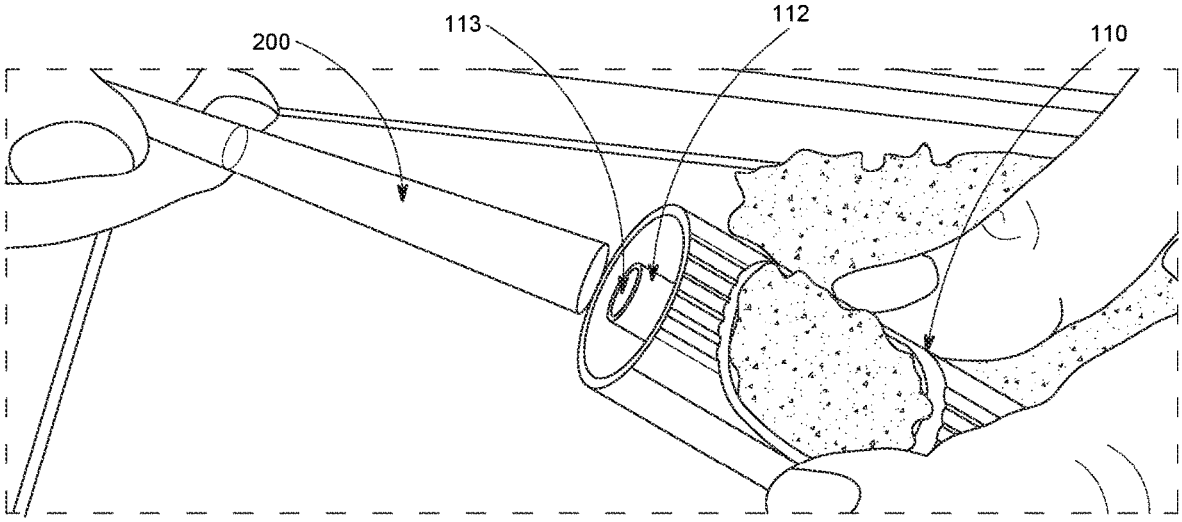
FIG. 3 shows a perspective view of a smoking cone being placed upon the cone connector nozzle of the hollow cylindrical body according to the preferred embodiment of the present invention of FIG. 1.
Figure 4:
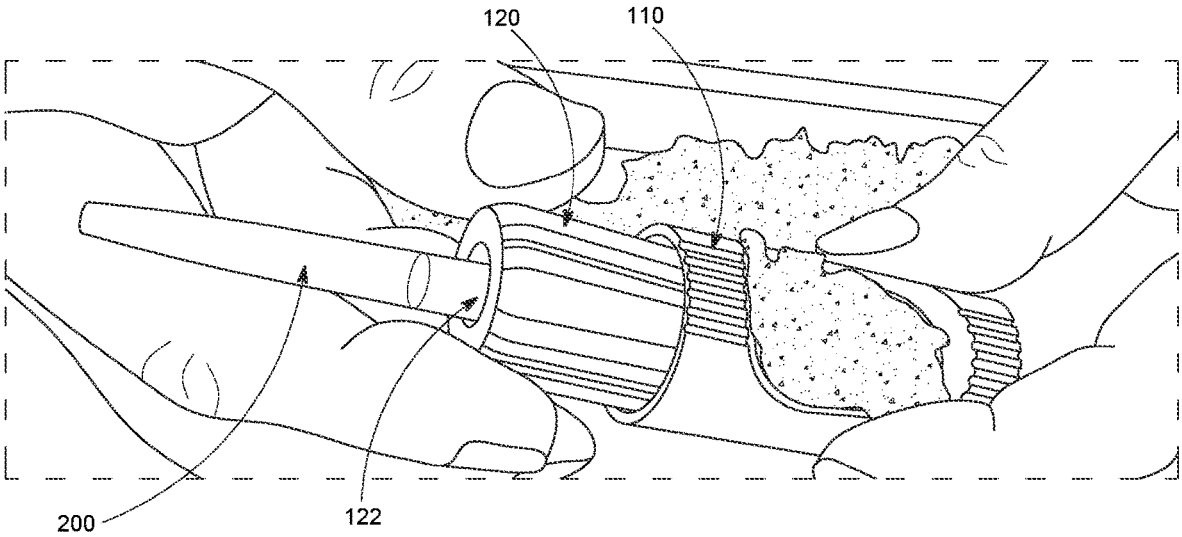
FIG. 4 shows a perspective view of the locking cap being attached to the hollow cylindrical body according to the preferred embodiment of the present invention of FIG. 1.
Figure 5:
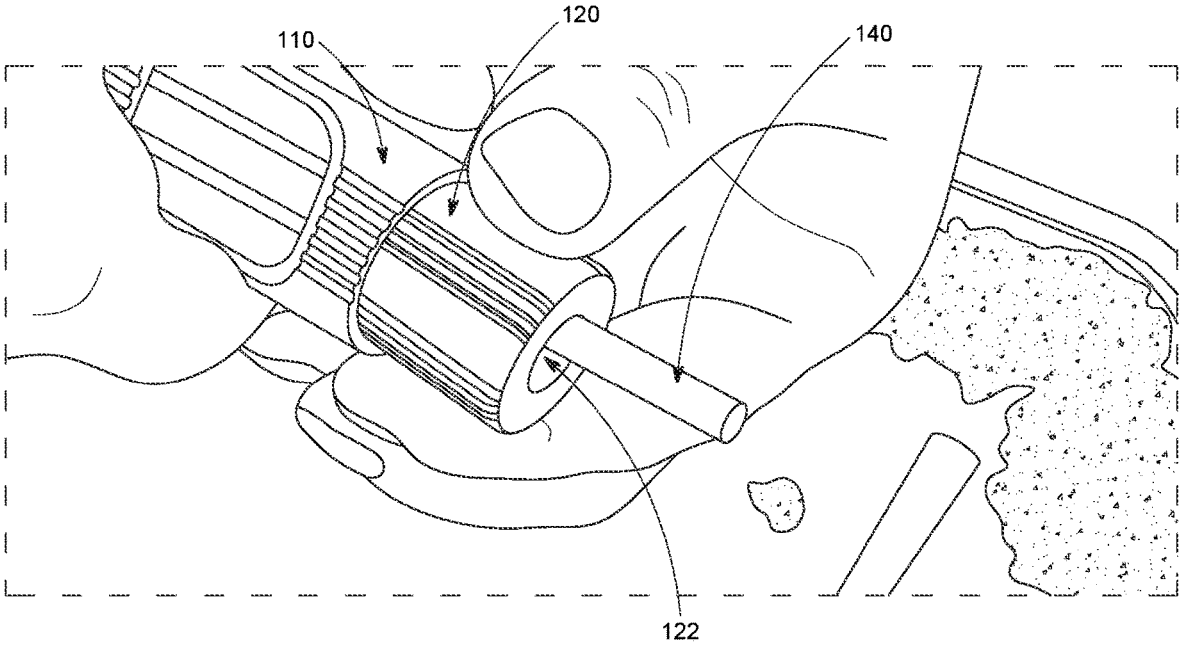
FIG. 5 shows a perspective view of the smoking cone pushed off of the cone connector nozzle after being filled according to the preferred embodiment of the present invention of FIG. 1.
Figure 6:
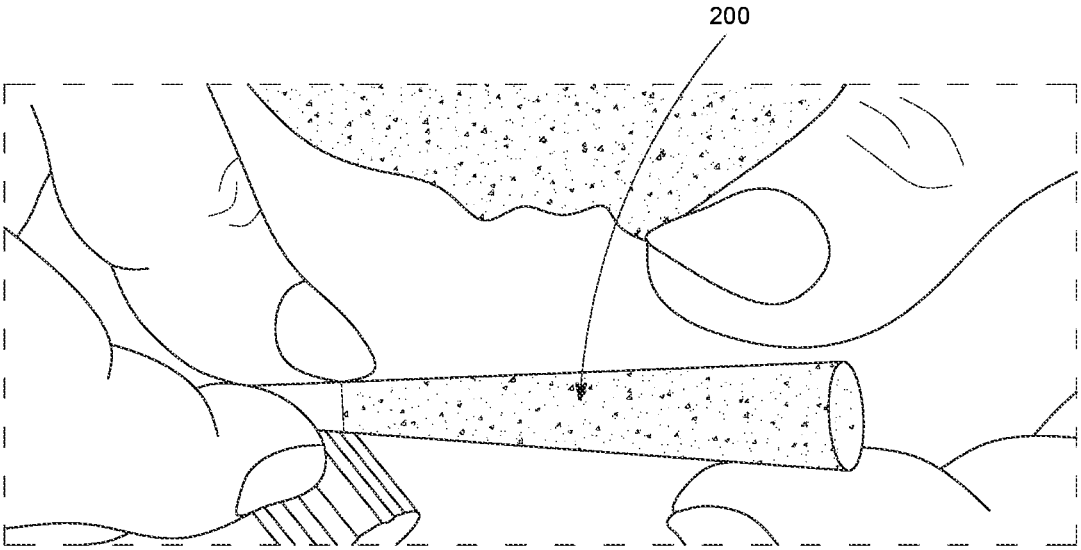
FIG. 6 shows a perspective view of a smoking cone after being filled by the preferred embodiment of the present invention of FIG. 1.

Turning now descriptively to drawing, referring to FIGS. 1-6, the present invention discloses an apparatus 100 for filling smoking cones comprising a hollow cylindrical body 110 including a cone connector nozzle 112 having an opening 113 therethrough, wherein the cone connector nozzle is located on a distal end of the hollow cylindrical body, and is adapted to releasably retain a smoking cone 200 thereon, a push-rod opening 114 located on a proximal end of the hollow cylindrical body opposite the distal end, and a filler port 116 located on a side portion of the hollow cylindrical body in between the proximal and distal ends and adapted to receive and retain smoking material therein. The hollow cylindrical body defines a length between the distal end and the proximal end. The apparatus further includes a locking cap 120 having a central aperture 122 adapted to allow a smoking cone 200 to pass therethrough, wherein the locking cap has a length, and is adapted to be releasably connected to the distal end of the hollow cylindrical body and releasably retain the smoking cone connected to the cone connector nozzle; and a push-rod 140 adapted to be movably placed through the push-rod opening 114 of the hollow cylindrical body and push the smoking material placed within the hollow cylindrical body filler port 116 through the opening in the cone connector nozzle 112 and into the smoking cone 200, wherein the hollow cylindrical body is adapted to be placed adjacent a tray 300 having smoking material 400 thereon and filled with a portion of the smoking material via the filler port 116, then one end of a smoking cone is adapted to be releasably attached to the cone connector nozzle 112, then the locking cap 120 is adapted to be placed over the smoking cone via the central aperture and releasably connected to the distal end of the hollow cylindrical body 110 to releasably retain the smoking cone 200 to the cone connector nozzle 112, then the push-rod 140 is adapted and used to push the smoking material through the opening of the cone connector nozzle and into the smoking cone.

The central aperture 122 of said locking cap 120 is formed having an elongated cylindrically-shaped opening adapted to prevent the smoking cone from collapsing while smoking material is being pushed therein. Further, the distal end of the hollow cylindrical body 110 and the locking cap 120 have interdigitating screw threads thereon to releasably connect the locking cap to the hollow cylindrical body. Further, the push-rod 140 comprises a handle portion 142 and an elongated rod portion 144, wherein the elongated rod portion is attached to the handle portion and extends therefrom, wherein the elongated rod portion has a length greater than the hollow cylindrical body and the locking cap combined, and wherein the handle portion has a diameter larger than a diameter of the elongated rod portion. Further, the push-rod opening 114 and the cone connector nozzle 112 are linearly aligned, wherein the push-rod can be movably moved back-and-forth through the push-rod opening and the cone connector nozzle at the same time. Further, the hollow cylindrical body 110, the locking cap 120, and the handle portion 142 of the push-rod include ridges 155 on outer surfaces thereof adapted to increase friction between the hollow cylindrical body and a person's hands while in use. Further, the filler port 116 may be formed having an oblong cup shape. And furthermore, the hollow cylindrical body, said locking cap, and said push-rod can be formed from a material chosen from a list of materials consisting of aluminum, copper, brass, fiberglass, steel, iron, and lead.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. An apparatus for filling smoking cones comprising:
- a hollow cylindrical body including:
  - a cone connector nozzle including:
    - an opening therethrough;
    - wherein said cone connector nozzle is located on a distal end of said hollow cylindrical body; and is adapted to releasably retain a smoking cone thereon;
  - a push-rod opening;
    - wherein said push-rod opening is located on a proximal end of said hollow cylindrical body opposite said distal end; and
  - a filler port;
    - wherein said filler port is located on a side portion of said hollow cylindrical body in between said proximal and distal ends; and
    - wherein said filler port is adapted to receive and retain smoking material therein;
  - wherein said hollow cylindrical body defines a length between said distal end and said proximal end;
- a locking cap including:
  - a central aperture;
    - wherein said central aperture is adapted to allow a smoking cone to pass therethrough;
  - wherein said locking cap has a length; and
  - wherein said locking cap is adapted to be releasably connected to said distal end of said hollow cylindrical body and releasably retain said smoking cone connected to said cone connector nozzle, and
- a push-rod;
  - wherein said push-rod is adapted to be movably placed through said push-rod opening of said hollow cylindrical body and push said smoking material placed within said hollow cylindrical body filler port through said opening in said cone connector nozzle and into said smoking cone;
- wherein said hollow cylindrical body is adapted to be placed adjacent a tray having smoking material thereon and filled with a portion of said smoking material via said filler port; then one end of a smoking cone is adapted to be releasably attached to said cone connector nozzle; then said locking cap is adapted to be placed over said smoking cone via said central aperture and releasably connected to said distal end of said hollow cylindrical body to releasably retain said smoking cone to said cone connector nozzle; then said push-rod is adapted and used to push said smoking material through said opening of said cone connector nozzle and into said smoking cone.

2. The apparatus for filling smoking cones of claim 1, wherein said central aperture of said locking cap is formed having an elongated cylindrically-shaped opening adapted to prevent said smoking cone from collapsing while smoking material is being pushed therein.

3. The apparatus for filling smoking cones of claim 1, wherein said distal end of said hollow cylindrical body and said locking cap have interdigitating screw threads thereon to releasably connect said locking cap to said hollow cylindrical body.

4. The apparatus for filling smoking cones of claim 1, wherein said push-rod comprises:
- a handle portion; and
- an elongated rod portion;
  - wherein said elongated rod portion is attached to said handle portion and extends therefrom;

wherein said elongated rod portion has a length greater than said hollow cylindrical body and said locking cap combined;

wherein said handle portion has a diameter larger than a diameter of said elongated rod portion.

5. The apparatus for filling smoking cones of claim 1, wherein said push-rod opening and said cone connector nozzle are linearly aligned; and wherein said push-rod is adapted to be movably moved back-and-forth through said push-rod opening and said cone connector nozzle at the same time.

6. The apparatus for filling smoking cones of claim 4, wherein hollow cylindrical body, said locking cap, and said handle portion of said push-rod include ridges on outer surfaces thereof adapted to increase friction between said hollow cylindrical body and a person's hands while in use.

7. The apparatus for filling smoking cones of claim 1, wherein said filler port has an oblong cup shape.

8. The apparatus for filling smoking cones of claim 1, wherein said hollow cylindrical body, said locking cap, and said push-rod are formed from a material chosen from a list of materials consisting of aluminum, copper, brass, fiberglass, steel, iron, and lead.

9. The apparatus for filling smoking cones of claim 1, wherein said push-rod opening is formed having a smaller diameter than said cone connector nozzle, such that a user can use said push-rod opening as a secondary cone connector nozzle for smaller diameter smoking cones; and wherein said cone connector nozzle can be used as a secondary push-rod opening when said push-rod opening is being used as a secondary cone connector nozzle.

* * * * *